US007770606B2

(12) United States Patent
Heger et al.

(10) Patent No.: US 7,770,606 B2
(45) Date of Patent: Aug. 10, 2010

(54) UPPER SIDE, IN PARTICULAR PAPER SIDE, AND PAPERMAKING-MACHINE FABRIC

(75) Inventors: Wolfgang Heger, Nideggen (DE); Klaus Fichter, Jüchen (DE)

(73) Assignee: Andritz Technology and Asset Management GmbH, Graz (AT)

( * ) Notice: Subject to any disclaimer, the term of this patent is extended or adjusted under 35 U.S.C. 154(b) by 0 days.

(21) Appl. No.: 12/226,052

(22) PCT Filed: Dec. 20, 2006

(86) PCT No.: PCT/EP2006/012272

§ 371 (c)(1),
(2), (4) Date: Oct. 7, 2008

(87) PCT Pub. No.: WO2007/115591

PCT Pub. Date: Oct. 18, 2007

(65) Prior Publication Data

US 2009/0308482 A1 Dec. 17, 2009

(30) Foreign Application Priority Data

Apr. 8, 2006 (DE) ..... 10 2006 016 660

(51) Int. Cl.
*D21F 1/10* (2006.01)
*D21F 7/08* (2006.01)
*D03D 23/00* (2006.01)

(52) U.S. Cl. ..... 139/383 A; 139/383 R; 139/408; 139/411; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS

| | | | | |
|---|---|---|---|---|
| 6,244,306 | B1 * | 6/2001 | Troughton | 139/383 A |
| 6,253,796 | B1 * | 7/2001 | Wilson et al. | 139/383 A |
| 6,334,467 | B1 * | 1/2002 | Barrett et al. | 139/383 A |
| 6,354,335 | B1 * | 3/2002 | Taipale et al. | 139/383 A |
| 6,379,506 | B1 * | 4/2002 | Wilson et al. | 162/348 |
| 6,413,377 | B1 * | 7/2002 | Wright | 139/383 A |
| 6,427,728 | B1 * | 8/2002 | Maguire et al. | 139/383 A |
| 6,533,901 | B2 * | 3/2003 | Taipale | 162/348 |

(Continued)

FOREIGN PATENT DOCUMENTS

DE 22 63 476 B2 3/1974

(Continued)

*Primary Examiner*—Bobby H Muromoto, Jr.
(74) *Attorney, Agent, or Firm*—Roylance, Abrams, Berdo & Goodman, L.L.P.

(57) ABSTRACT

An upper side for a multiple-layer sheet-forming fabric has a multiplicity of longitudinal threads woven with a multiplicity of transverse threads and thereby form repeats in the longitudinal and transverse directions. The transverse-thread repeat contains three times as many threads as the longitudinal-thread repeat. The longitudinal-thread repeat has at least three threads. The transverse-thread repeat has at least nine threads. All longitudinal threads run alternately over three transverse threads and under three transverse threads, and subsequently under the remaining transverse threads of a transverse thread repeat. Two directly adjacent longitudinal threads are displaced with respect to one another in the longitudinal direction by at least three transverse threads.

11 Claims, 7 Drawing Sheets

U.S. PATENT DOCUMENTS

| | | | | |
|---|---|---|---|---|
| 6,585,006 | B1 * | 7/2003 | Wilson et al. | 139/383 A |
| 6,904,942 | B2 * | 6/2005 | Odenthal | 139/383 A |
| 7,048,829 | B2 * | 5/2006 | Heger et al. | 162/348 |
| 2004/0238063 | A1 * | 12/2004 | Stone | 139/383 A |

FOREIGN PATENT DOCUMENTS

| | | | |
|---|---|---|---|
| DE | 25 40 490 | B2 | 4/1976 |
| DE | 29 17 694 | C2 | 12/1979 |
| DE | 31 43 433 | A1 | 5/1983 |
| DE | 33 18 985 | A1 | 11/1984 |
| DE | 38 01 051 | A1 | 7/1989 |
| DE | 38 17 144 | A1 | 11/1989 |
| DE | 39 10 019 | A1 | 10/1990 |
| DE | 41 07 633 | A1 | 12/1991 |
| DE | 42 29 828 | A1 | 3/1994 |
| DE | 100 30 650 | C1 | 5/2002 |
| EP | 0 097 966 | B1 | 1/1984 |
| EP | 0 186 406 | A3 | 7/1986 |
| EP | 0 069 101 | B1 | 5/1987 |
| EP | 1 093 096 | A2 | 4/2001 |
| GB | 2 391 557 | A | 2/2004 |
| WO | WO 93/00472 | | 1/1993 |

* cited by examiner 119
120
12
11
10
9
8
7
6
5
4
3
2
1
21
22
23
24
21'
22'
23'
24'
21"
22"
23"
24"
21'''
22'''
23'''
24'''

UPPER SIDE, IN PARTICULAR PAPER SIDE, AND PAPERMAKING-MACHINE FABRIC

FIELD OF THE INVENTION

The present invention relates to the structure of an upper side, in particular a paper side for a multilayer papermaking-machine fabric. The papermaking-machine fabric, in particular, is intended for use in the wet end in a papermaking machine.

BACKGROUND OF THE INVENTION

In the wet end of a papermaking machine, the sheet of paper is formed on one or between two papermaking machine fabrics, depending on the machine type. Here a suspension of approximately 1% fiber substances and auxiliary substances and 99% water is uniformly delivered onto the papermaking machine fabric. The solid components contained are separated from the water by a filtration process. By using different drainage elements as far as the end of the wet end, usually a solid portion or dry content from 20 to 22% is attained. The paper produced in this way is already sufficiently solid so that it is transferred to the press end and can be further dried. In modern papermaking machines such as gap formers, the technique for executing this filtration process has been improved to such an extent that at speeds of 2,000 m/minutes and more, much less than one second is necessary for this purpose.

While a series of quantities in paper technology, such as the degree of whiteness, tensile strength and extension, are determined by the raw materials and auxiliary substances used, the sheet forming fabrics have a major effect on the substance weight profile and transverse thickness profile, the fiber retention and the fabric marking which is visible in the paper. In particular, in the area of graphic papers, these quality requirements are high. These quality requirements are opposed by the fact that visibly lower quality raw materials such as scrap paper are used and that by reducing the substance weight the attempt is made to save raw materials and thus money.

In the development of sheet forming fabrics for papermaking machines, a reaction rather early to these trends and various solutions was implemented to reach a compromise between a fineness of the paper side as high as possible and a machine side as durable and coarse as possible to achieve a high wear life time and overall high stability of the wire cloth.

To meet these requirements, double-layer wire cloths were developed characterized by a longitudinal thread system with at least two transverse thread systems, at least one transverse thread system being woven in solely on the paper side and the second exclusively on the machine side. Some embodiments of these sheet forming fabrics can be found among others in the following patent documents: EP 0 186 406 A3, DE 31 43 433 A, DE 25 40 490 B2, DE 22 63 476 B2, DE 38 17 144 A1, DE 38 01 051 A1, DE 39 10 019 A1, and in DE 41 07 633 C2.

Although this type of sheet forming fabric is also often used today, all these cloths are characterized by a comparatively low water permeability due to the machine direction threads which are located tightly next to one another. Furthermore, with this type of cloth it is not possible to produce an ideal paper side recognized as a linen weave and to join it to a lower cloth. Accordingly, frequently unwanted markings occur in the paper.

To remedy these disadvantages, efforts have been made to develop a fabric in which the paper side has a linen weave. The three-layer composite cloths have at least two separate cloth layers, with the upper layer characterized by the linen weave and connected in a suitable manner to the other cloth layers. To join the layers to one another, in the known solutions separate binding threads are used forming both the longitudinal threads and also the transverse direction threads. Furthermore, this connection can also be produced in that longitudinal and transverse thread systems of one cloth are tied into the other cloth by the binding threads changing over from one cloth layer into the next and vice versa. Some examples of this can be found in the following documents: DE 33 18 985 A1, DE 42 29 828 C2, DE 29 17 694 C2, EP 01 093 096 B1, EP 0 069 101 B1, EP 0 097 966 B1 and WO 93/00472.

With these types of known cloths, the uniformity of the upper side could be improved such that the marking left in the paper is much less than for a two-layer fabric. Also, permeability was maintained for a comparatively large number of threads on the paper side. This led to increased use of three-layer fabrics for the indicated graphic papers.

But the multilayer structure greatly increases the thickness of the papermaking machine fabric, by which more material can be intercalated in the cloth and the drainage performance is reduced in this way. Another disadvantage of the three-layer composite cloth relates to the joining of the layers. The individual cloth layers connected to one another by binding threads extending in the papermaking machine are often stressed in bending by deflections, relative to a neutral phase in the middle of the fabric, one layer undergoing stretching, at the same time the fabric layer opposite the neutral phase being shortened. Loosening of the cloth connection generally then occurs. This loosening can lead to shifting of the layers in the advanced stage with separation of the cloth layers occurring in the extreme case, leading to the papermaking machine fabric becoming unusable.

In DE 100 30 650 C1, to counteract layer separation, the machine direction threads can be used as binding threads with the result that by changing the longitudinal thread or machine direction threads from the paper to the machine side and vice versa the stretching and shortening of the two cloth sides are equalized. Even this type of weave cannot compensate for the structure-induced higher thickness of the composite cloth with its reduced drainage performance.

SUMMARY OF THE INVENTION

An object of the present invention is to provide an improved upper or paper side of a papermaking machine fabric implementing the advantages of a linen weave, and yet having a simple, compact and durable structure for the cloth in addition to the papermaking machine fabric for which the cloth is used.

This object is basically achieved by a fabric upper side and a papermaking machine fabric where the upper or paper side has a plurality of longitudinal threads woven with a plurality of transverse threads to form repeats in the longitudinal and transverse directions. The transverse thread repeat contains three times as many threads as the longitudinal thread repeat. The longitudinal thread repeat has at least of three threads, while the transverse thread repeat has at least nine threads. All longitudinal threads extend in alternation over three transverse threads and under three transverse threads and then under the remaining transverse threads. Two directly adjacent longitudinal threads in the longitudinal direction are shifted against one another by at least three transverse threads.

The upper side according to the present invention is made in an approximation to the longstanding linen weave and in this respect allows production of mark free paper. The special execution of the upper side allows high drainage. If the upper side is provided with the correspondingly suited additional cloth layers on the lower side, a compact and durable structure is achieved which counteracts the unwanted separation of layers. The upper or paper side can be economically obtained on conventional weaving means so that special, expensive mechanical means can be dispensed with. By using at least three machine direction threads, additional machine-side transverse direction threads can be tied in and, for purposes of an ideal linen weave, high uniformity for the upper side or upper cloth layer of a papermaking machine fabric is achieved.

This weave principle can be extended to almost any number of longitudinal threads in the repeat and can be easily implemented for three, five and six longitudinal threads within one repeat. The more longitudinal threads in the repeat, the more the length ratio of the longitudinal threads to the transverse direction threads on the upper side shifts in the direction of the transverse direction threads. In this respect the weave becomes increasingly wider. In theory, this aspect is detrimental to the uniformity of the paper side, but produces increasingly better support for the paper fibers emerging mainly lengthwise from the stock inlet of the papermaking machine. Depending on the requirements arising in practice, in this simple way the upper side can be easily matched to the prevailing circumstances.

In one especially advantageous embodiment of the invention, the upper side is delivered to heat setting. As a result of the heat setting, longitudinal extension and conversion of the cloth structure occur, in which the longitudinal threads in the region in which they bind with the upper transverse threads no longer extend strictly vertically or in the longitudinal direction, but are oriented slightly diagonally.

The integration of the machine-side transverse threads, that is, of the lower cloth, with the upper cloth or the upper side, can take place in many ways. In one preferred embodiment, the ratio of three upper transverse threads to two lower transverse threads is chosen. The pitch of the lower cloth is preferably two here. This arrangement corresponds to the pick ratio. The pick repeat of the lower cloth is chosen to be twice as long to implement a floatation of the lower transverse threads extending over eight shafts. Fundamentally, other transverse thread ratios are also conceivable here. Also, the length of the floatation of the lower transverse threads can take place in integral multiples of the upper longitudinal thread repeat.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

The present invention relates to a multilayer papermaking machine fabric having one paper side which is intended to correspond in an approximation to the conventional linen weave (cf. FIG. 6), but by using a plurality of machine direction threads is intended to enable integration of additional machine-side transverse threads.

Figure 6:
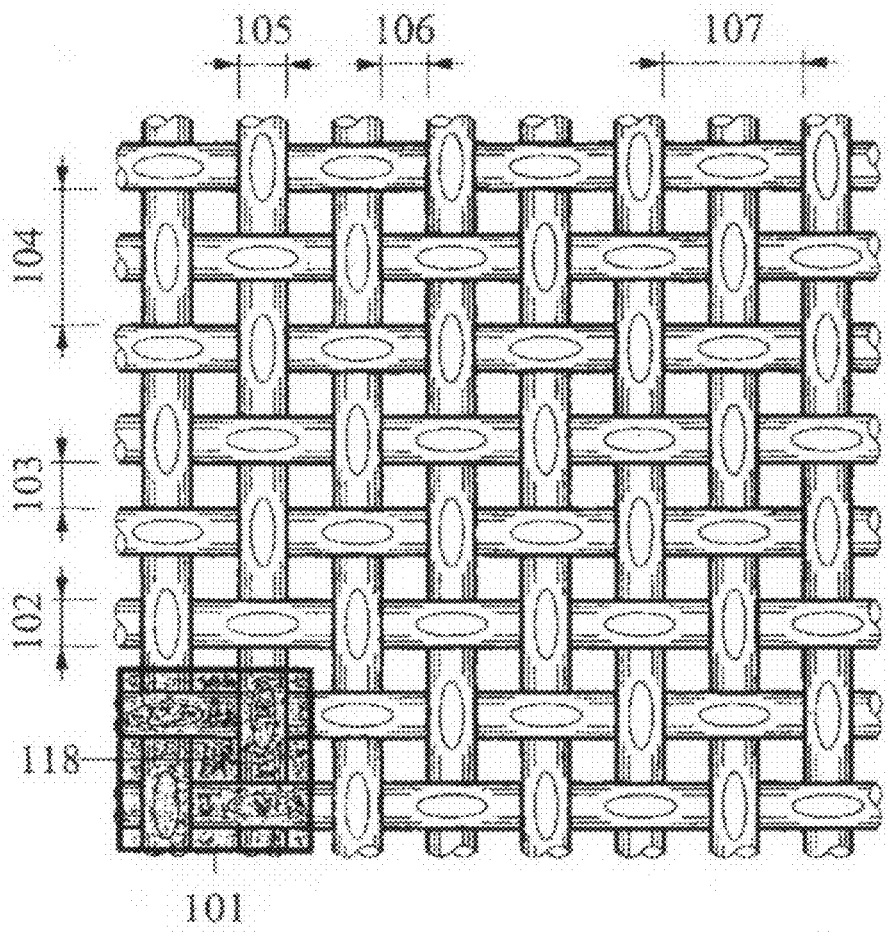
FIG. 6 is a plan view of a conventional linen weave.

If the ideal conventional linen weave is examined more closely, as shown in FIG. 6, the high uniformity of this weave is dictated mainly by the short repeat 101 of only two longitudinal threads and transverse direction threads each. If in addition the same number of threads and thread diameters are used in the longitudinal direction and transverse direction, a square mesh and a uniform height of transverse thread and longitudinal thread bending are obtained.

Under the condition thread number=2/thread diameter, the distance 102 and 105 between the adjacent meshes is equal to the mesh width 106 and the mesh length 103. In order to approximate the pertinent linen-like upper side as closely as possible, the solution according to the present invention among other things calls for the following:

- using at least three machine direction threads,
- their distance to one another is less than 20% of the diameter of a longitudinal thread, and
- making the transverse thread repeat three times as long as the longitudinal thread repeat,
- each machine direction thread has to run in alternation over three and under three transverse threads and then under the upper side, and
- the weave has a pitch three.

Figure 4:
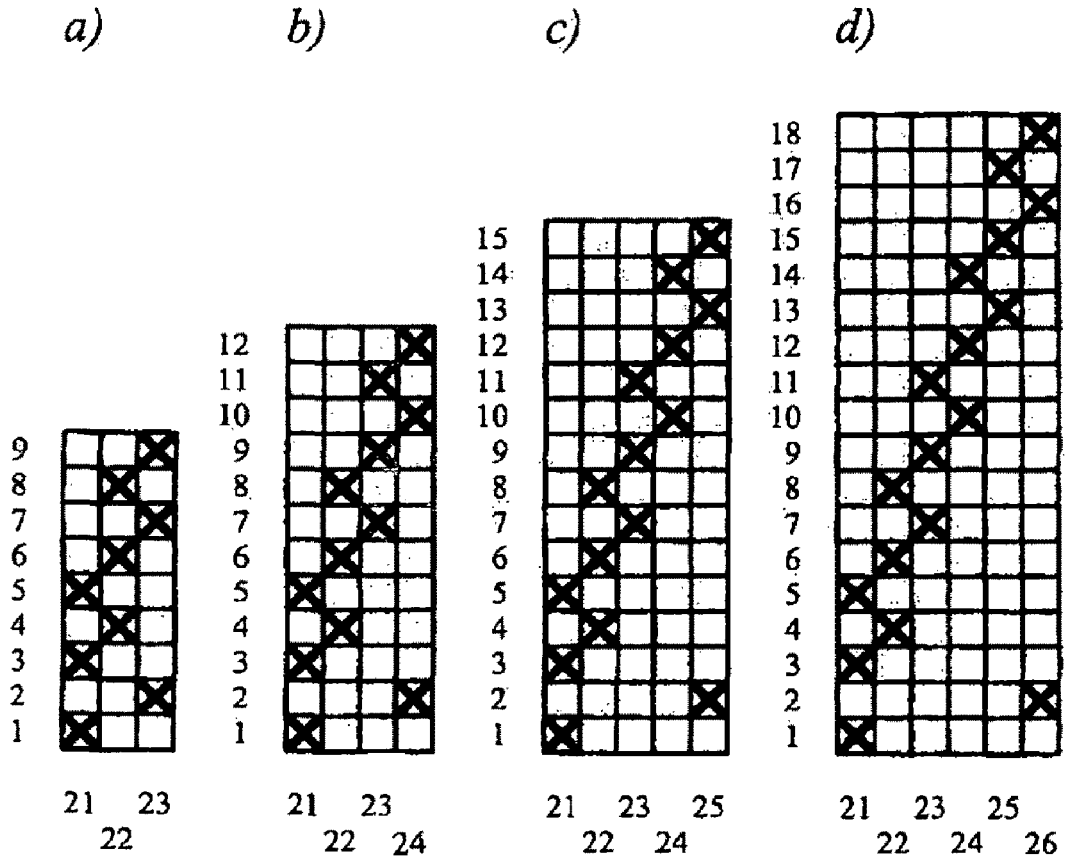
FIG. 4*a*) is a diagrammatic representation of a longitudinal thread repeat of three threads and a transverse thread repeat of nine threads.
FIG. 4*b*) is a diagrammatic representation of a longitudinal thread repeat of four threads and a transverse thread repeat of twelve threads.
FIG. 4*c*) is a diagrammatic representation of a longitudinal thread repeat of five threads and a transverse thread repeat of 15 threads.
FIG. 4*d*) is a diagrammatic representation of a longitudinal thread repeat of six threads and a transverse thread repeat of 18 threads.

FIG. 4 shows the pertinent weaving principle using four different longitudinal thread repeats. In this figure, as is conventional in textile technology, the machine direction threads are represented by columns and the transverse threads by lines. Furthermore, crossing points at which the respective longitudinal thread runs over an assignable transverse thread are marked by a cross.

In FIG. 4*a*) the solution according to the present invention is applied to a longitudinal thread repeat of three threads 21 to 23. The transverse thread repeat has a length of nine threads 1 to 9, the first longitudinal thread 21 binding in alternation with the picks 1 to 6, over relative to picks 1, 3, and 5 and under relative to picks 2, 4, and 6. Thereafter the longitudinal thread remains underneath the picks 7 to 9.

The longitudinal thread 22 directly adjacent to the right runs analogously, but shifted up by three transverse threads. The picks missing at the top are added underneath the starting point. This displacement is conventionally referred to with the term "pitch". The longitudinal thread 22 therefore begins on the transverse thread 4 and subsequently runs like the longitudinal thread 21.

FIG. 4*b*) shows one preferred embodiment of the solution according to the present invention with a longitudinal thread repeat of four threads 21 to 24. The transverse thread repeat thus amounts to twelve threads 1 to 12 and thus a length which is three times as long as the longitudinal thread repeat. Here the first six picks 1 to 6 are also integrated by the longitudinal thread 21 in alternation over 1, 3, and 4 and under 2, 4, and 6. The remaining picks 7 to 12 remain underneath the longitudinal thread 21. Comparable arrangements arise for the other longitudinal threads 22, 23, and 24.

Figure 7:
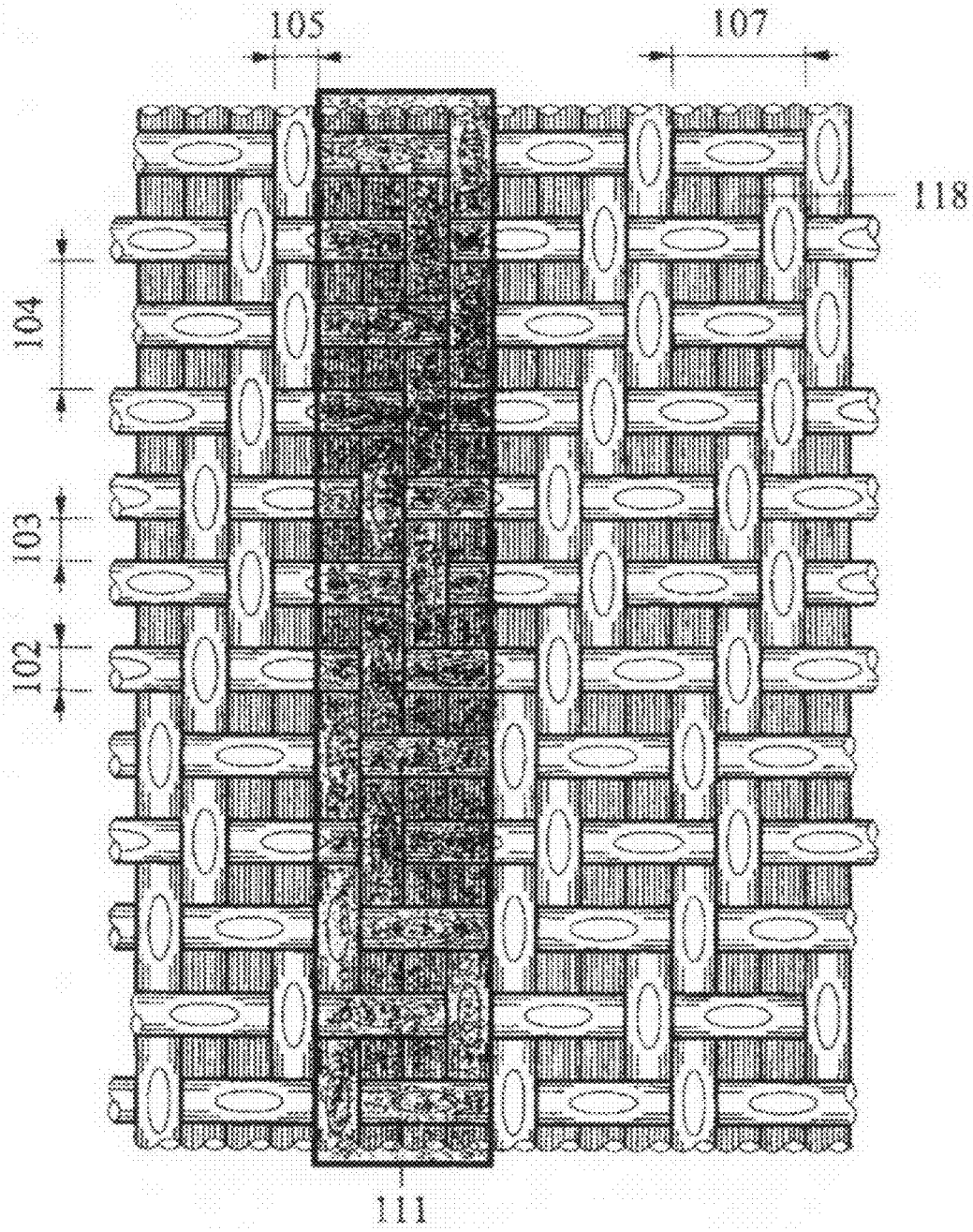
FIG. 7 is a schematic plan view of the upper side with a longitudinal thread repeat of four threads and a transverse thread repeat of twelve threads.

The schematically woven surface according to the weave diagrams shown in FIG. 4*b*) is in FIG. 7. For the same diameters of the longitudinal and transverse threads 102 and 105 and the same transverse thread distances 103. The float lengths of the longitudinal and transverse threads 104 and 107 can be represented identically. Only the mesh width 106 is different.

Figure 1:
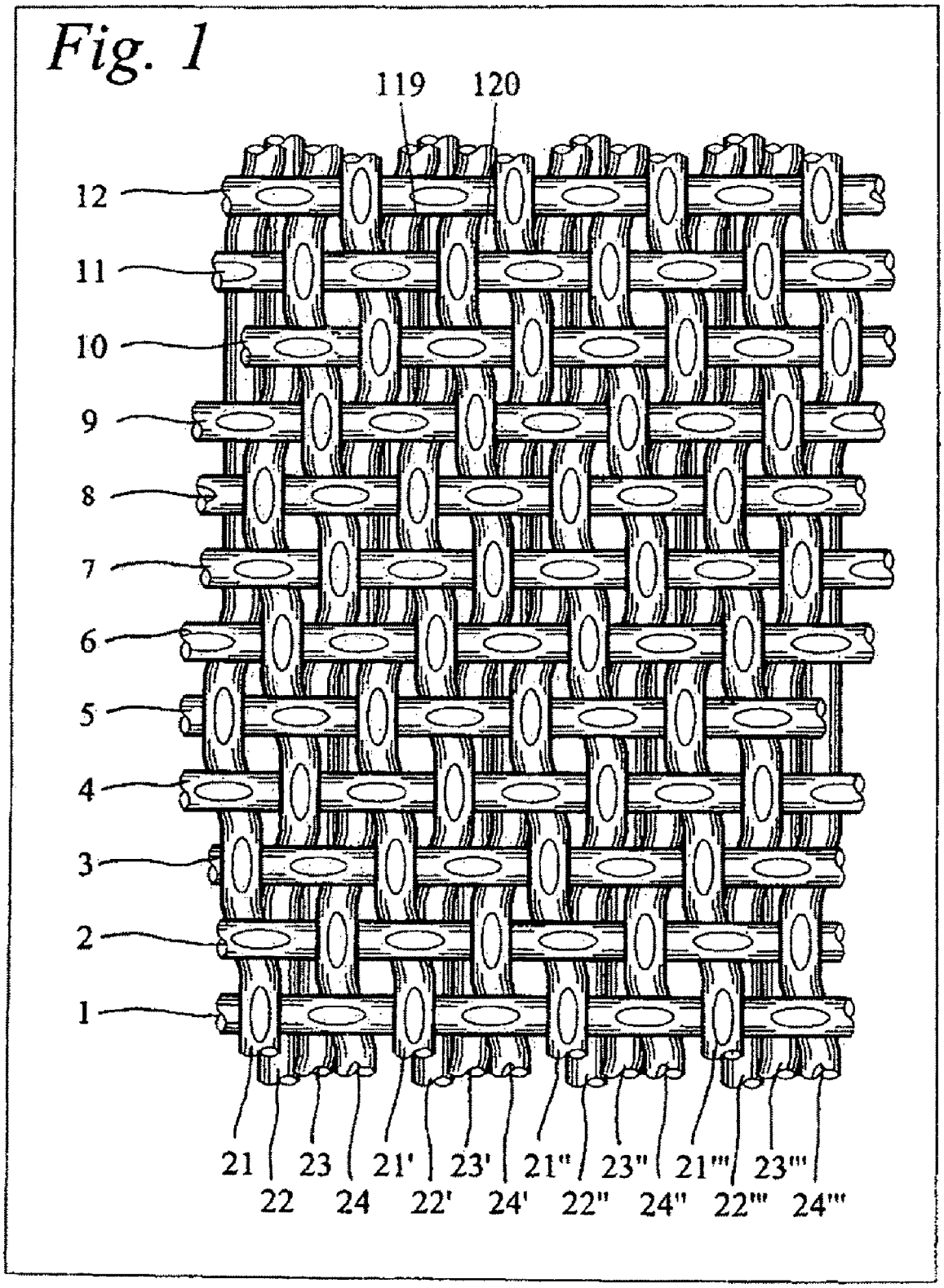
FIG. 1 is a plan view of a cloth surface with a longitudinal thread repeat of four threads and a transverse thread repeat of twelve threads according to the description of a weave design as shown in FIG. 4*b*) and according to a first exemplary embodiment of the present invention.

If a conventional heat setting process is employed for the plastic threads used, by changing the longitudinal extension during heat setting, a conversion of the structure arises which is shown schematically in FIG. 1.

The longitudinal threads 21 to 24''' in the region in which they bind with the upper transverse threads 1 to 5 no longer run or extend aligned strictly vertically or in the longitudinal direction, but are slightly diagonally oriented. Along the longitudinal thread 21, for example, viewed in FIG. 1, this means that the warp rise over the transverse thread 1 is farther to the right than the one over the transverse thread 3, and the longitudinal thread rise over the transverse thread 5 is located farthest to the left. This arrangement is achieved in that the transverse threads which have been woven in relatively straight with extension of the longitudinal threads are bent into the plane of the figure and in the process reorient the longitudinal threads. From a large mesh 118 thus two smaller ones 119 and 120 (FIG. 1) are obtained which are similar to the meshes in the linen weave 108.

This weave principle can be extended to almost any number of longitudinal threads in the repeat. This extension is shown by example in FIGS. 4*a*), 4*c*) and 4*d*) for three, five, and six longitudinal threads. The more longitudinal threads in the repeat, the more or greater the length ratio of longitudinal thread to transverse thread on the upper side shifts in the direction of the transverse thread. This arrangement leads to a corresponding widening. Relative to the uniformity of the paper side this widening is undesirable, but instead causes increasingly better support for the paper fibers emerging mainly lengthwise from the stock outlet of the papermaking machine. Depending on feasibility considerations, in this way the upper side can be easily matched to prevailing circumstances. The first embodiment shown in FIG. 1 in this respect illustrates the surface of the design according to the present invention with a longitudinal thread repeat of four threads 21 to 24 and transverse thread repeat of twelve threads 1 to 12 according to the weave diagram as shown in FIG. 4*b*). Repeats or thread arrangements which repeat accordingly are indicated with an apostrophe following the respective reference number.

In the first embodiment the first longitudinal thread 21 alternately binds with the first six transverse threads 1 to 6 over and under and then runs or extends only underneath the remaining transverse threads 7 to 12. Each of the next longitudinal threads 22, 23, and 24 within the repeat rise by three transverse threads respectively, in this instance up to the right. As in any weave, essentially a pitch to the left is also possible, as a result of which then a mirror image of the surface would result (not shown).

Figure 2:
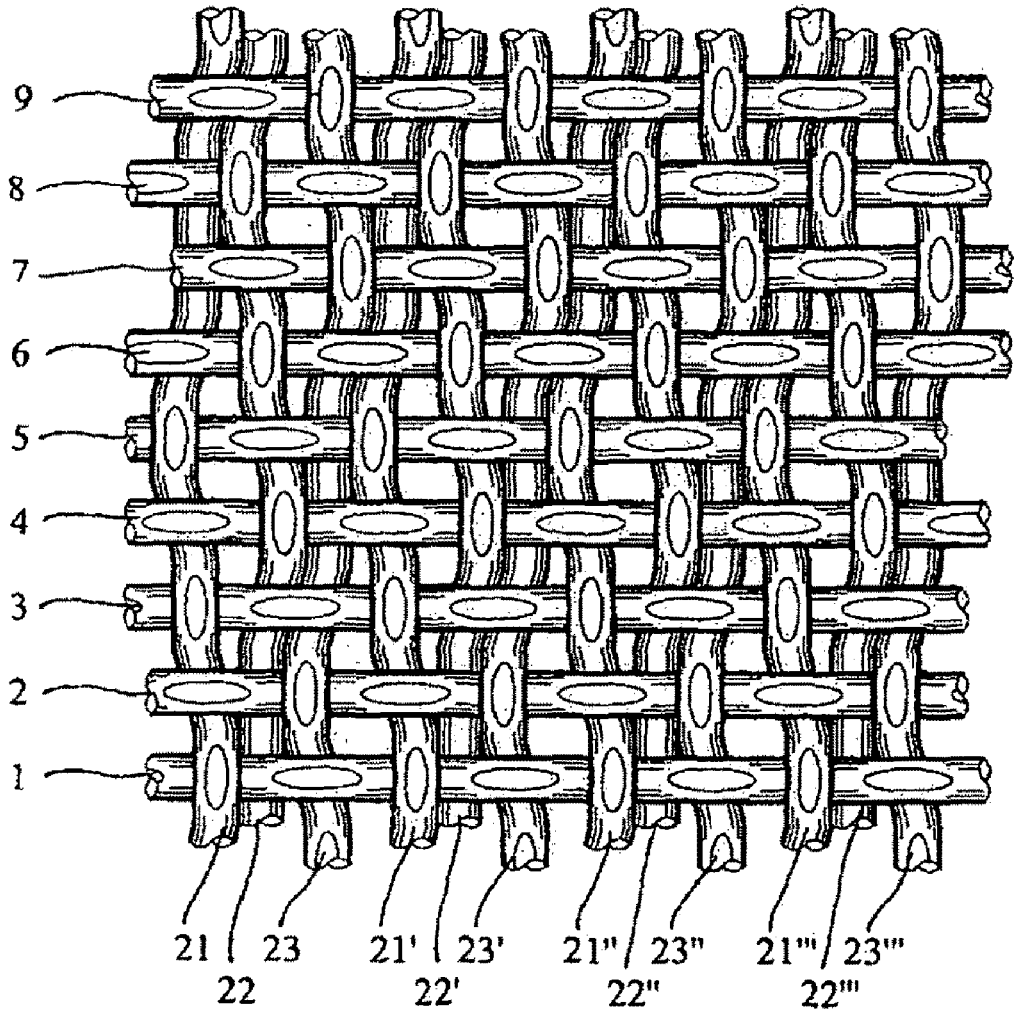
FIG. 2 is a plan view of a cloth surface with one longitudinal thread repeat of three threads and one transverse thread repeat of nine threads according to the description of a weave design as shown in FIG. 4*a*) and according to a second exemplary embodiment of the present invention.
Figure 3:
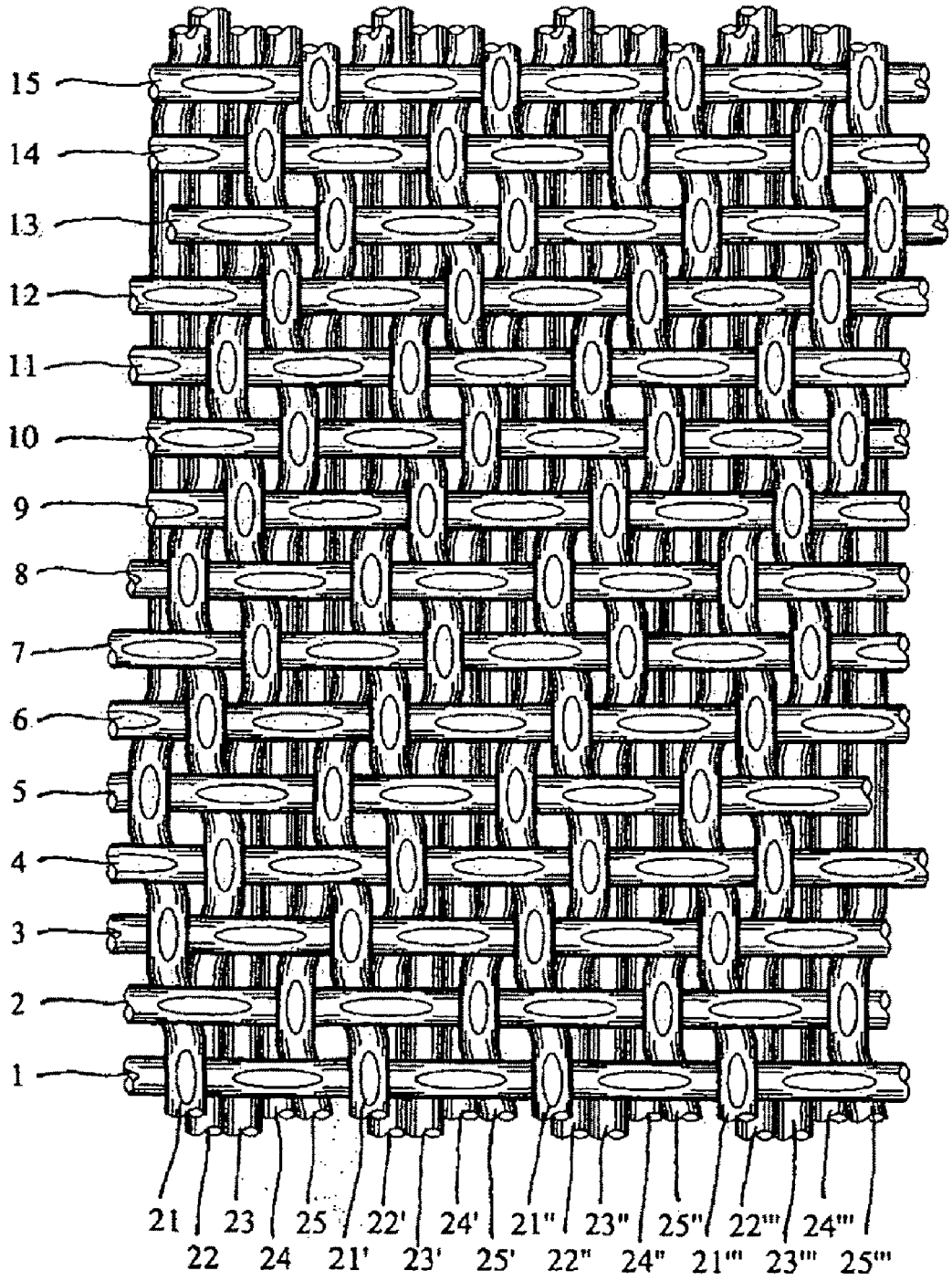
FIG. 3 is a plan view of a cloth surface with one longitudinal thread repeat of five threads and one transverse thread repeat of 15 threads according to the description of a weave design as shown in FIG. 4*c* and according to a third exemplary embodiment of the present invention.

In the embodiments as shown in FIGS. 2 and 3, one embodiment with a longitudinal thread repeat of three and five threads is shown. Here a total of four longitudinal thread repeats next to one another is shown in order to impart a better impression of the surface.

Figure 5:
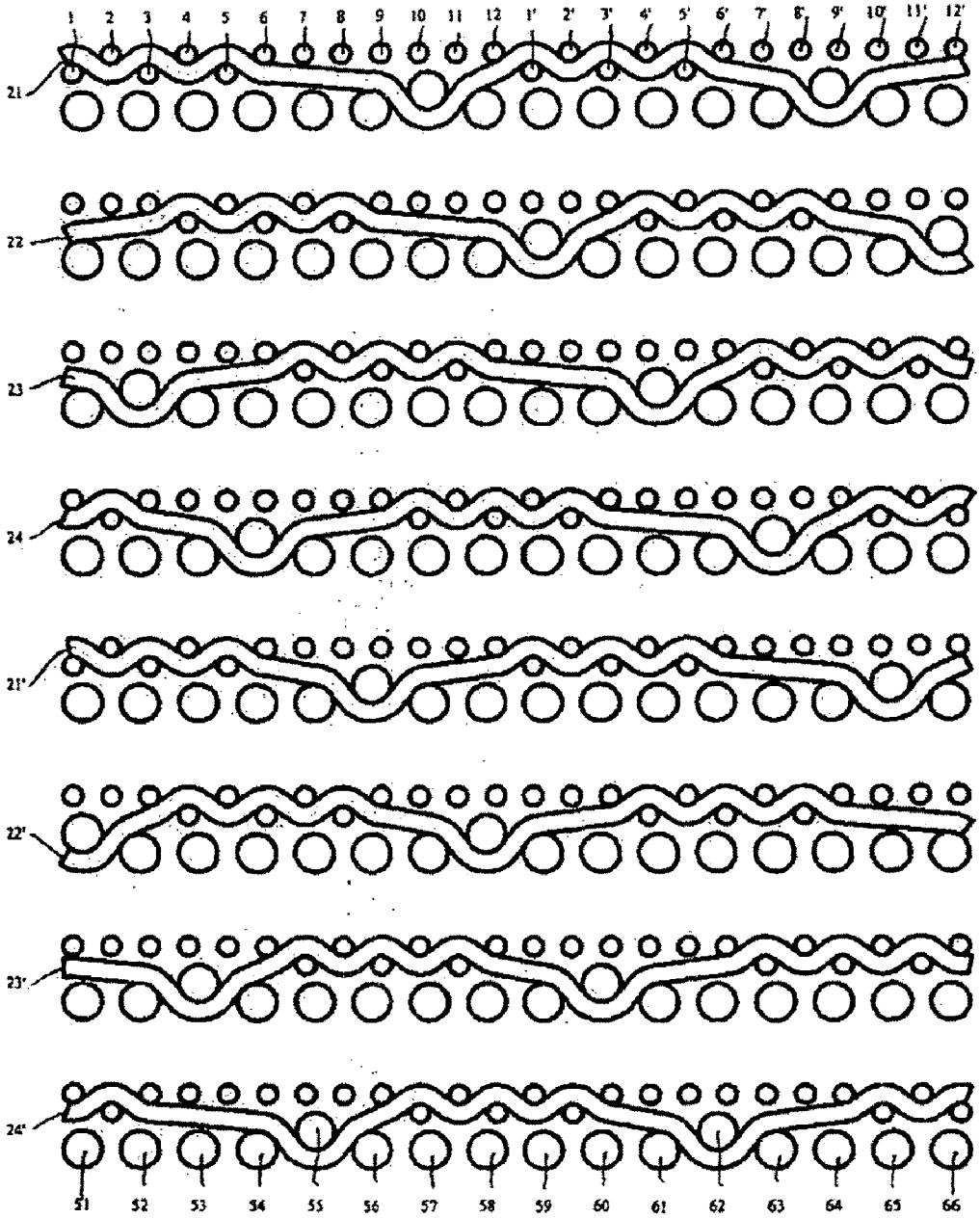
FIG. 5 are side elevational views of a longitudinal thread progression of one embodiment of a surface with a longitudinal thread repeat of four threads, a transverse thread repeat of twelve threads and integrated machine-side picks.

In the fourth embodiment shown in FIG. 5, the use of the surface according to the present invention there is shown in a double-layer sheet forming fabric as the papermaking machine fabric, the longitudinal threads being shown in their progression and the transverse threads cut. In this way it is shown how the region of the longitudinal threads extending underneath the upper transverse threads can be used for integrating the lower transverse threads. The region located underneath the transverse threads 6 to 12 or 6' to 12' for the longitudinal thread 21.

The surface used here corresponds to the embodiment of FIG. 1 with a longitudinal thread repeat of four threads and with a transverse thread repeat of twelve threads. The transverse thread number was selected in a ratio of the three upper transverse threads to the two lower transverse threads. At the given pitch of the upper cloth of three, the pitch for the lower cloth is two. Thus both the ratios of the transverse thread number and the pitch between the upper and lower cloth are the same. This arrangement benefits the structure as a whole. With the embodiment shown in FIG. 5 the float length of the lower transverse threads is made twice as long as the longitudinal thread repeat of the upper cloth, that is, a total of eight threads is included at the same time. The surface according to the present invention can thus be used as the paper side for a plurality of different machine sides and thus lower cloths.

While various embodiments have been chosen to illustrate the invention, it will be understood by those skilled in the art that various changes and modifications can be made therein without departing from the scope of the invention as defined in the appended claims.

What is claimed is:

1. An upper side for a multilayer sheet forming fabric, comprising:

a plurality of longitudinal threads woven with a plurality of transverse threads and thereby forming longitudinal and transverse thread repeats in longitudinal and transverse directions, respectively, the transverse thread repeat consisting of only three times as many threads as the longitudinal thread repeat, the longitudinal thread repeat having at least of three threads, the transverse thread repeat having at least of nine threads, all longitudinal threads extending in alternation over and under three transverse threads and then under the remaining transverse threads of the transverse thread repeat, two directly adjacent longitudinal threads being shifted against one another in the longitudinal direction by at least three transverse threads.

2. The upper side according to claim 1 wherein the longitudinal thread repeat has four, five, or six longitudinal threads; and the transverse thread repeat respectively has twelve, fifteen, or eighteen transverse threads.

3. The upper side according to claim 1 wherein a distance of the respective transverse threads of one transverse thread repeat to one another is less than 20% of a diameter of a longitudinal thread.

4. The upper side according to claim 1 wherein the longitudinal threads extend diagonally in regions in which the longitudinal threads bind with the upper transverse threads.

5. The upper side according to claim 1 wherein the upper side is a paper side.

6. The upper side according to claim 1 wherein a weave of the longitudinal and traverse threads is in a wet end of a papermaking machine.

7. A papermaking machine fabric, comprising:

an upper side including a plurality of longitudinal threads woven with a plurality of transverse threads and thereby forming longitudinal and transverse thread repeats in longitudinal and transverse directions, respectively, the transverse thread repeat consisting of only three times as many threads as the longitudinal thread repeat, the longitudinal thread repeat having at least of three threads, the transverse thread repeat having at least of nine threads, all longitudinal threads extending in alternation over and under three transverse threads and then under the remaining transverse threads of the transverse thread repeat, two directly adjacent longitudinal threads being shifted against one another in the longitudinal direction by at least three transverse threads.

8. The papermaking machine fabric according to claim 7 wherein two layers are provided with a ratio of three upper transverse threads of an upper cloth formed by the upper side to two of lower transverse threads of a lower cloth.

9. The papermaking machine fabric according to claim 7 wherein a pitch of the lower cloth is two.

10. The papermaking machine fabric according to claim 8 wherein a length of a float formed by the longitudinal threads above the lower transverse threads is in integral multiples of the upper longitudinal thread repeat.

11. The papermaking machine fabric according to claim 10 wherein the float runs over eight of the lower transverse threads.

* * * * *